United States Patent [19]

Banys

[11] 3,970,349

[45] July 20, 1976

[54] GRAVITY STABILIZED INTERNESTING CARRIER SYSTEM FOR MECHANIZED FILING AND STORAGE CABINETS

[75] Inventor: Algis R. Banys, Reno, Ohio

[73] Assignee: Sperry Rand Corporation, New York, N.Y.

[22] Filed: June 30, 1975

[21] Appl. No.: 591,855

Related U.S. Application Data

[63] Continuation of Ser. No. 466,823, May 3, 1974, abandoned.

[52] U.S. Cl. ..... 312/268; 312/134; 312/223

[51] Int. Cl.[2] ..... A47B 49/00

[58] Field of Search ..... 312/91, 134, 223, 266, 312/268; 198/137, 152; 211/121

[56] References Cited

UNITED STATES PATENTS

| | | | |
|---|---|---|---|
| 776,980 | 12/1904 | Altmann | 198/152 |
| 1,978,205 | 10/1934 | Ide | 312/268 |
| 3,178,247 | 4/1965 | Wittrup et al. | 312/268 |
| 3,236,577 | 2/1966 | Anders et al. | 312/268 |
| 3,321,260 | 5/1967 | Anders et al. | 312/268 |
| 3,639,023 | 1/1972 | Anders et al. | 312/268 |

*Primary Examiner*—Casmir A. Nunberg
*Attorney, Agent, or Firm*—Griffin, Branigan and Butler

[57] ABSTRACT

A mechanized filing system comprises a plurality of carrier pans mounted on an endless chain conveyor. Two chains rotate respectively about upper and lower sprockets with the carrier pans being attached between them by means of scissors-like suspension arms. The carrier pans define symmetrical, wide, wedge shaped, upper camming surfaces on the top sides thereof and symmetrical, wide, V-shaped lower camming surfaces, complementary to the wedge-shaped upper camming surfaces, on the lower sides thereof. The wedge shaped upper camming surfaces mesh with the V-shaped lower camming surfaces when the carrier pans complete rotation about the sprockets. The carrier pans are rotatably attached to the suspension arms at points relatively close to their wedge-shaped upper camming surfaces. The carrier pans also include guide pins attached to their outer end surfaces which contact stationary nesting guide cams mounted on a stationary frame for stabilizing the carrier pans only when they are improperly oriented for nesting.

20 Claims, 5 Drawing Figures

FIG. 2
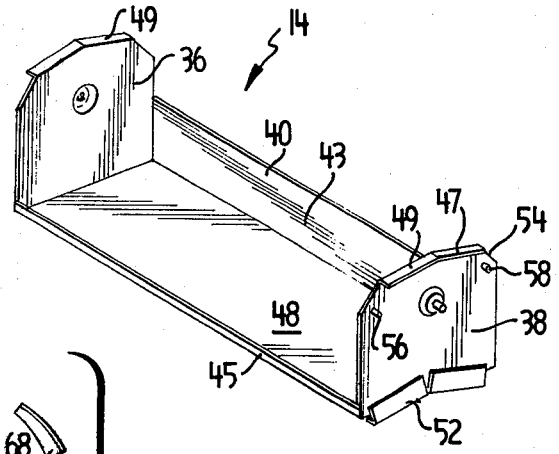
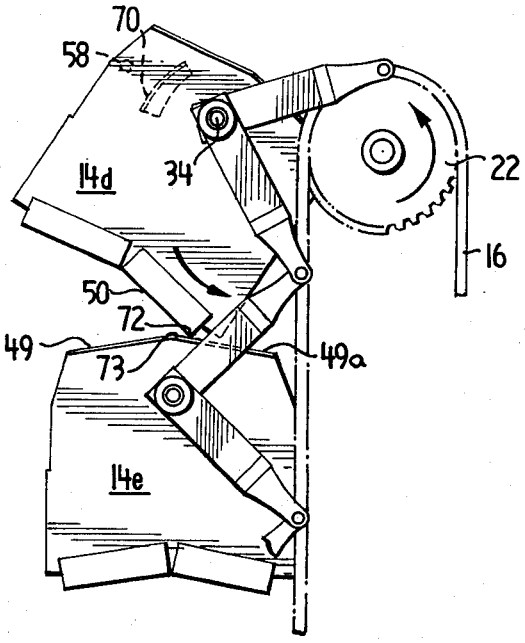
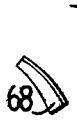
FIG. 4
FIG. 5
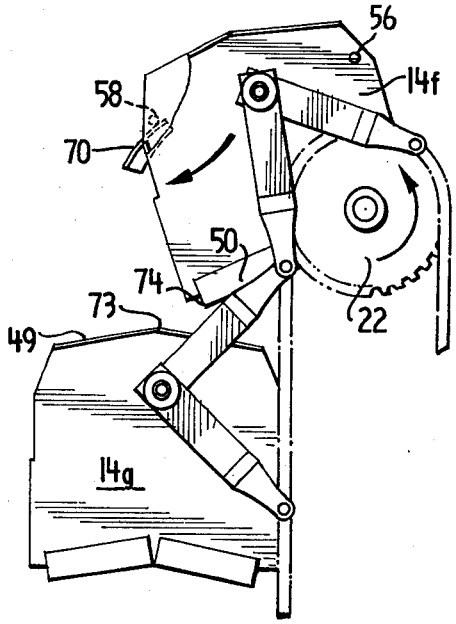
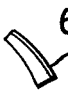

GRAVITY STABILIZED INTERNESTING CARRIER SYSTEM FOR MECHANIZED FILING AND STORAGE CABINETS

This is a continuation, of application Ser. No. 466,823, filed May 3, 1974 now abandoned.

BACKGROUND OF THE INVENTION

This invention relates broadly to the art of mechanized power-operated filing cabinets and more particularly to such filing cabinets wherein carrier pans thereof are rotated in orbital fashion by an endless conveyor past an access opening.

Filing cabinets which are related to the instant invention are described in U.S. Pat. Nos. 3,199,658 to Graber et al, 3,236,577 to Anders et al and 3,321,260 to Anders.

Each of these patents describes a mechanized filing cabinet wherein filing pans are mounted on side-by-side endless chains. The chains rotate about sprockets to convey the carrier pans vertically upward, around upper sprockets, vertically downward, around lower sprockets and again upward. The carrier pans are accessible from access openings located along their vertical paths of travel and can be stopped at these openings.

A problem exists for each of these systems in stabilizing the carrier pans during their travel around the sprockets. In this regard, the carrier pans are rotatably suspended from the suspension arms but, in the case of each of these patents, the attitudes of the carrier pans are guided as the carrier pans travel about the sprockets by cam rollers mounted on the carrier pans and semi-circular cam tracks mounted on stationary frames. Also, in each case, the carrier pans include small V-shaped cams on the bottom outside surfaces thereof which mesh with pins positioned at the tops of adjacent carriers pans when the carrier pans travel in vertical paths. Thus, the carrier pans are held by the tracks in proper attitudes around corners and internest on straight, vertical stretches for purposes of stabilization.

A primary difficulty with these systems is that they require tracks at both upper and lower ends of the conveyors as well as an expensive carrier-pin roller on each pan to mesh with the tracks. This structure adds to the overall complexity and cost of these machines. Thus, it is an object of this invention to provide an endless conveyor-type mechanized filing cabinet which does not require unduly expensive carrier-pan guiding mechanisms at upper and lower ends of the endless conveyor.

It is also an object of this invention to provide a mechanized filing cabinet which is effective in operation and convenient to use.

SUMMARY OF THE INVENTION

According to principles of this invention, carrier pans of an endless conveyor-type mechanized filing cabinet are primarily gravity stabilized during their travel around conveyor corners. The carrier pans have relatively wide wedge and V-shaped camming surfaces at respective upper and lower sides thereof for automatically bringing the carrier pans into internesting, relation after they have gone around corners.

Stationary nesting guide cams are included at an upper turn to rotate the carrier pans to nominal orientations if they are tilted to such an extent that their wedge and V-shaped camming surfaces will not properly intermesh.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 2 is an isometric view of a carrier pan employing principles of this invention;

FIG. 4 is a schematic, partial side view of the mechanism depicted in FIG. 1, illustrating carrier-pan, camming-surface correction action when a carrier pan is tilted in a clockwise direction; and FIG. 5 is a view similar to FIG. 4 depicting stationary-nesting-cam correcting action when a carrier pan is unduly tilted in a counter-clockwise direction.

DESCRIPTION OF A PREFERRED EMBODIMENT

Figure 1:
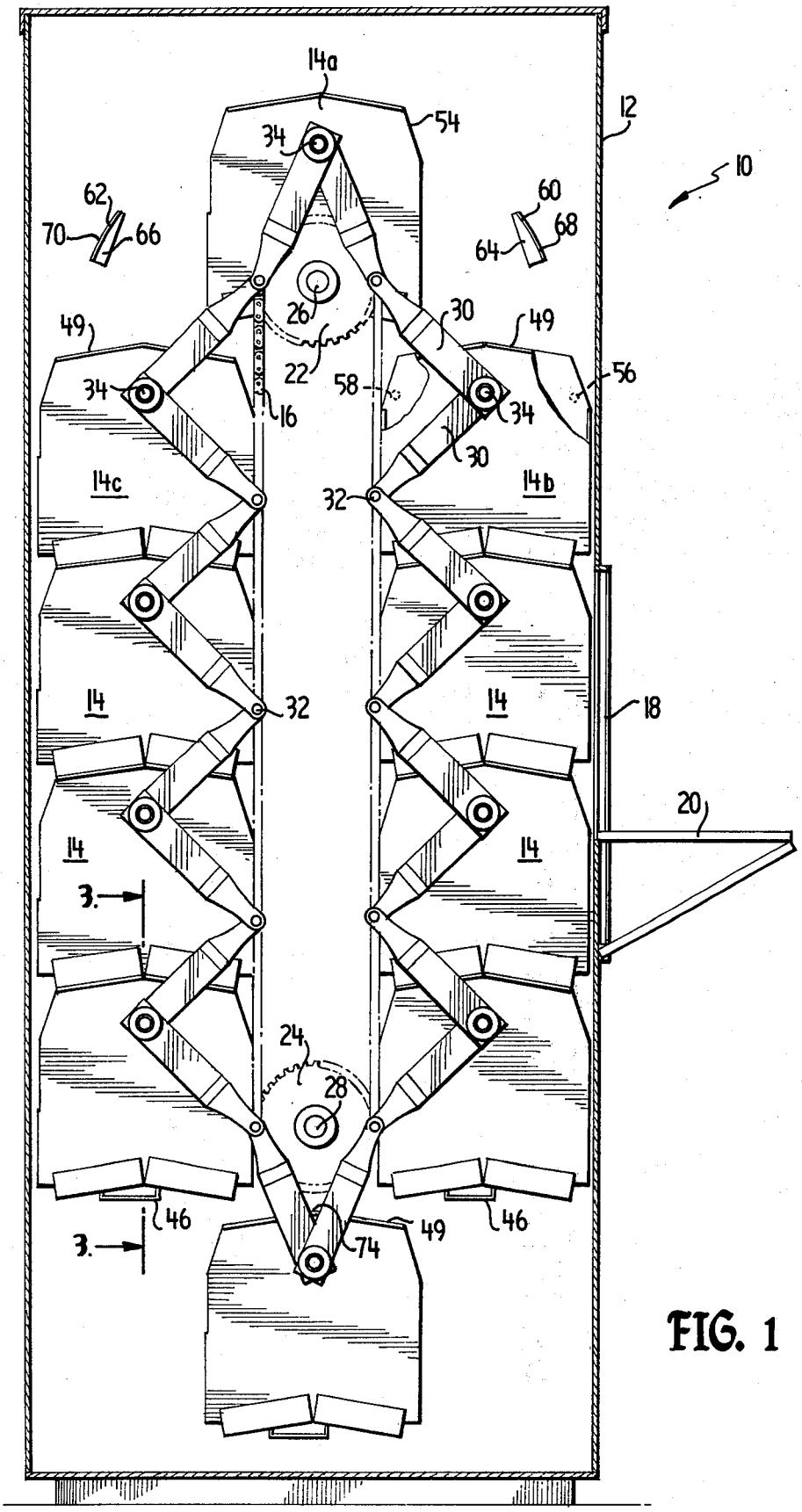
FIG. 1 is side view, partially in section, of a mechanized filing cabinet employing principles of this invention.

With reference to FIG. 1, a mechanized filing cabinet 10 includes an outer frame 12, carrier pans 14, and driving chains 16.

The outer frame 12 defines an access opening 18 adjacent a posting board 20.

There are two side-by-side driving chains 16 (only one shown) each being mounted on an upper and a lower sprocket 22 and 24 (only one of each shown). The upper sprockets 22 are idling sprockets which are rotatably mounted to the frame 12 by means of shafts 26 (only one shown). The lower sprockets 24 are rotatably mounted to the frame 12 by a single driven shaft 28 (driving means not shown).

The carrier pans 14 are mounted between the chains 16 by scissors-like suspension arms 30. The suspension arms 30 are rotatably mounted to the chains 16 by chain pins 32 and are rotatably mounted to the carrier pans 14 at suspension points by pan pins 34.

Figure 3:
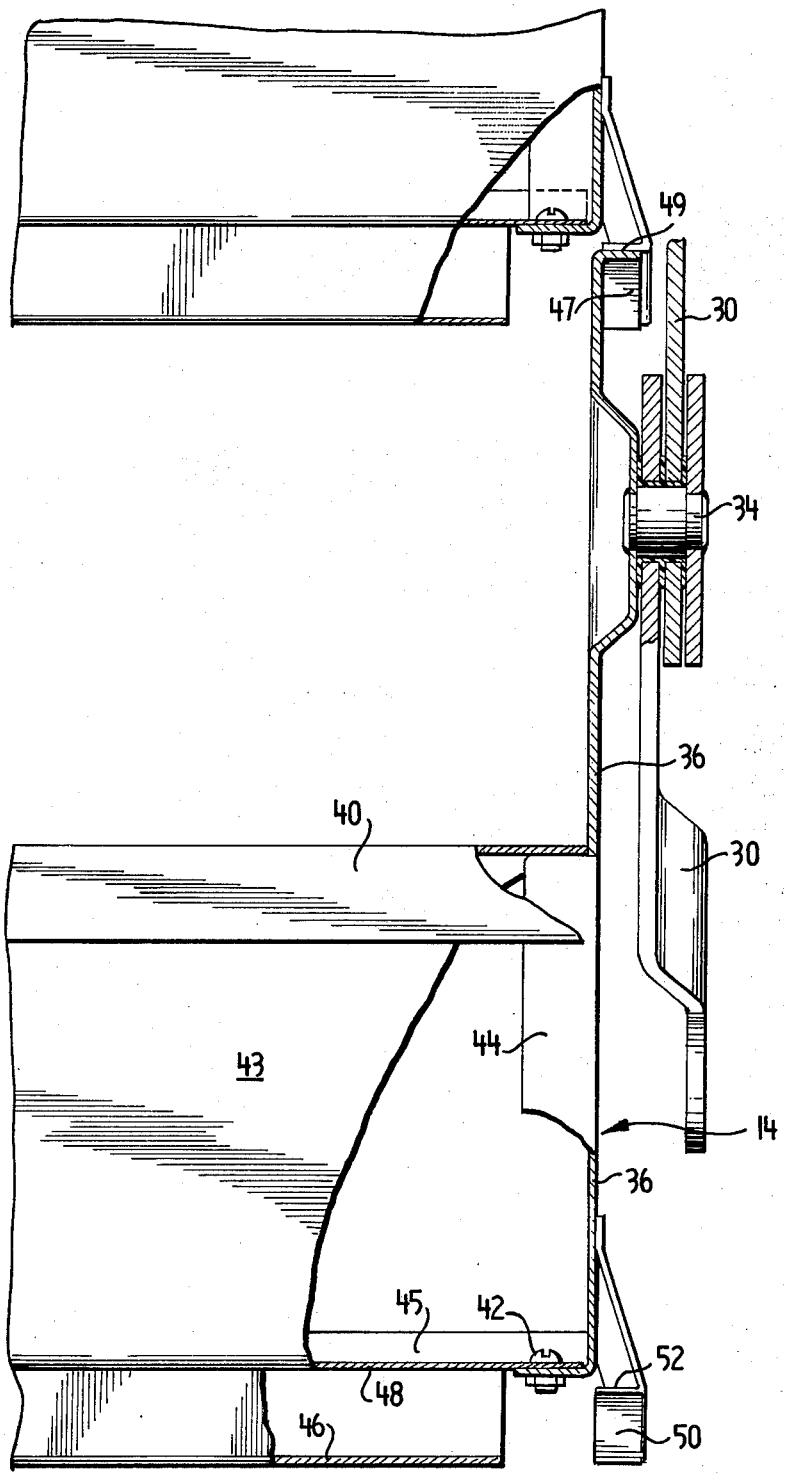
FIG. 3 is a sectional view taken on line 3—3 in FIG. 1.

The carrier pans 14, are identical in structure so only one carrier pan is described herein in detail, with this description being applicable to all of the carrier pans. Referring to FIGS. 2 and 3, a carrier pan comprises left and right end plates 36 and 38, and a combination back/bottom shelf 40. The combination back/bottom shelf 40 is bolted to the left and right end plates 36 and 38 as at 42, with the back portion 43 of the back/bottom shelf 40 being folded over flanges 44 of the end plates 36 and 38. The back/bottom shelf 40 is also folded to form a lip 45 at the front of the carrier pan 14 to prevent material from falling out of the carrier pan if it is tilted. A stiffener 46 is welded to the bottom portion 48 of the back/bottom shelf 40 to add strength to the relatively thin bottom portion 48.

Flanges 47 of the left and right end plates 36 and 38 form symmetrical, wedge shaped, upper camming surfaces 49 for each of the carrier pans. Symmetrical, inverted-V-shaped lower camming surfaces 50 are defined by angle plates 52 which are welded to the outer surfaces of the left and right end plates 36 and 38. It should be noted that the upper camming surfaces 49 are shaped to fit into, and intermesh with, the lower camming surfaces 50. It should also be noted that the upper and lower camming surfaces 49 and 50 extend almost across the entire depth of the carrier pan with the exception that the carrier pan has the upper corners thereof cutaway at 54 to provide clearance for other structural components of the overall machine. In this regard, the lengths of the upper and lower camming surfaces should preferably be the full depth of the carrier pans, but could be reduced to two-thirds the depths of the carrier pans where necessary.

With reference to FIG. 2, each of the carrier pans 14 has front and rear guide pins 56 and 58 protruding from the upper corner of one end thereof.

Stationary nesting cams 60 and 62 (FIG. 1) are mounted on the inside of the outer frame 12 by flanges 64 and 66. The stationary nesting cams respectively provide camming surfaces 68 and 70 which contact the front and rear guide pins 56 and 58 to correct the attitudes of the carrier pans when they are unduly tilted prior to nesting, as will be described below.

In operation, assuming the driven shaft 28 is driven in a counter-clockwise direction so that the driving chains 16 drive the carrier pans 14 in a counter-clockwise direction, as the carrier pans 14 move along vertical upward and downward paths they are stabilized by intermeshing of upper wedge-shaped and lower V-shaped camming surfaces 49 and 50. When a carrier pan, such as carrier pan 14*a* in FIG. 1 for example, is carried about sprockets 22 it moves faster than the following carrier pan 14*b* so that it is lifted off of the upper camming surfaces 49 of the carrier pan 14*b*. At this point the carrier pan 14*a* is gravity stabilized such that its tilt depends upon the position of the suspension pins 34 and the weight distribution of its load. After the carrier pan 14*a* has travelled around the sprockets 22, its lower camming surfaces 50 are brought into contact with the upper camming surfaces 49 of the immediately preceding carrier pan 14*a*. In a similar manner, when carrier pans travel around the lower sprockets 24 their upper camming surfaces 49 disengage lower camming surfaces of following carrier pans and reengage lower camming surfaces of preceding carrier pans.

Ordinarily, if loads in the carrier pans 14 are properly balanced the carrier pans do not unduly tilt when they disengage adjacent, carrier-pan camming surfaces to travel around sprockets. In this event, the front and rear guide pins 56 and 58 do not make contact with the stationary cam surfaces 68 and 70 when the carrier pans travel around the upper sprockets 22. In this regard, the wedge and V-shaped upper and lower camming surfaces 49 and 50, are so wide that they make sliding contact with one another even though one carrier pan is tilted an abnormal amount to insure that the pans remesh into the proper orientation.

However, assuming that the weight of the material in a carrier pan is improperly balanced so that the carrier pan, 14*d* (FIG. 4), for example, is unduly tilted in a clockwise direction, as this carrier pan passes over the upper sprocket 22, the right-hand corner 72 of the lower camming surface 50 contacts a right side 49*a* of the upper camming surface 49 of the preceding carrier pan 14*e*. After this contact is made the camming surfaces automatically slide together to bring the carrier pan 14*d* into a proper orientation. It should be noted that in this case the stationary nesting surface 70 does not contact the rear guide pin 58.

Now assuming that a carrier pan 14*f* (FIG. 5) is loaded to cause a counter-clockwise tilt, the rear guide pin 58 of this carrier pan engages the cam surface 70 to rotate the carrier pan 14*f* in a clockwise direction, thereby insuring that the left corner 74 of the lower camming surface 50 clears the crown 73 of an upper camming surface 49 of a preceding carrier pan 14*g*. Once this is accomplished, the upper and lower camming surfaces intermesh to automatically orient the carrier pan 14*f*.

The front stationary nesting camming surface 68 is similarly used to correct undue clockwise rotation of carrier pans when the sprocket 24 and the chains 16 are rotated in a clockwise direction.

It should be noted that camming surfaces similar to front and rear camming surfaces 68 and 70 are not needed to aid in intermeshing upper and lower camming surfaces 49 and 50 as carrier pans 14 are rotated about the lower sprocket 24 because pan pins 34 are located at relatively high suspension points, close to the crowns 73 of the upper camming surfaces 49. Thus, undue tilting cannot vary the positions of the upper camming surfaces to such an extent that they will not properly mesh with the preceding lower camming surfaces.

It should also be noted that the mechanized filing cabinet of this invention does not require an expensive track and roller guiding system for aiding carrier pans to negotiate conveyor turns as does the prior art described above.

While the invention has been particularly shown and described with reference to a preferred embodiment, it will be understood by those skilled in the art that various changes in form and detail may be made therein without departing from the spirit and scope of the invention. For example, it would be possible, within this invention, to limit chain rotation to one direction. In this case, the pan cam surfaces could be unsymmetrical about the pan pins 34.

The embodiments of the invention in which an exclusive property or privilege are claimed are defined as follows:

I claim:

1. An interesting carrier pan assembly comprising:

a plurality of carrier pans for holding and storing items;

an endless conveyor, said endless conveyor comprising a flexible endless member riding on, and extending between, at least two wheels, and suspension arms for suspending said carrier pans from said flexible endless member but for allowing said carrier pans freedom of rotation about suspension points, said flexible endless member and said suspension arms holding each of said carrier pans in contact with an adjacent carrier pan while transporting it along a straight, substantially vertical path but holding each of said carrier pans out of contact with adjacent carrier pans while transporting it along curved paths about said wheels;

wherein each of said carrier pans includes an end member having an upper camming surface on the top side thereof, a lower camming surface, complementary to said upper camming surface, on the lower side thereof, for meshing with said upper camming surface of an adjacent carrier pan when said endless conveyor moves these carrier pans into contact with one another to cause a previously free one of said carrier pans to assume a desired attitude relative to the other of these carrier pans; and, a stationary camming means for allowing said carrier pans to freely rotate about said suspension points and thereby achieve attitudes as are determined by weight distributions in said carrier pans while said carrier pans are being transported along said curved paths but for contacting said carrier pans toward the end of at least one of said curved paths for correcting the rotational orientations of said carrier pans prior to their making contact with respective adjacent carrier pans by rotating the carrier pans back to acceptable angular positions only if they are tilted beyond predetermined degrees.

2. An internesting carrier pan assembly as claimed in claim 1 wherein at least one of said upper and lower camming surfaces of each of said carrier pans is V-shaped with the mouth thereof being relatively wide with respect to the depth of said carrier pan.

3. An internesting carrier pan assembly as claimed in claim 2 wherein the mouth of said at least one camming surface is at least two-thirds of the depth of said carrier pan, and wherein said stationary camming means is located only at an uppermost wheel for only correcting the rotational orientations of said carrier pans as they are transported about said uppermost wheel.

4. An internesting carrier pan assembly as claimed in claim 3 wherrein said upper camming surface is wedge shaped and said lower camming surface is V-shaped.

5. An internesting carrier pan assembly as claimed in claim 2 wherein each of said carrier pans includes a protruding guide member protruding from the side thereof and wherein said stationary camming means comprises a cam for contacting said protruding guide members when carrier pans are at said predetermined tilts prior to their making contact with respective adjacent carrier pans.

6. An internesting carrier pan assembly as claimed in claim 2 wherein said suspension arms are rotatably attached to the end members of said carrier pans at suspension points located relatively close to said upper camming surfaces.

7. An internesting carrier pan assembly as claimed in claim 1 wherein said upper camming surface of each of said carrier pans is wedge shaped and said lower camming surface is V-shaped.

8. An internesting carrier pan assembly as claimed in claim 1 wherein said suspension arms are rotatably attached to the end members of said carrier pans at suspension points located relatively close to said upper camming surfaces.

9. An internesting carrier pan assembly comprising:

a plurality of carrier pans for holding and storing items;

an endless conveyor, said endless conveyor comprising a flexible endless member riding on, and extending between at least two wheels, with at least one of said wheels being driven, and suspension arms for suspending said carrier pans from said flexible endless member but for allowing said carrier pans freedom of rotation about suspension points so as to achieve attitudes as are determined by weight distributions of loads in said carrier pans, said flexible endless member and said suspension arms holding each of said carrier pans in contact with an adjacent carrier pan while transporting it along a straight, substantially vertical path but holding each of said carrier pans out of contact with adjacent carrier pans while transporting it along curved paths about said wheels, said carrier pans being unguided and therefore free to rotate about said suspension points while being transported along at least one of said curved paths to achieve attitudes as are determined by weight distribution of loads in said carrier pans;

wherein each of said carrier pans comprises:

an upper camming surface on the top side thereof, and a lower camming surface, complementary to said upper camming surface on the lower side thereof for meshing with said upper camming surface of an adjacent carrier pan when said endless conveyor moves these carrier pans into contact with one another to rotate a previously free one of said carrier pans to assume a desired attitude relative to the other of these carrier pans, at least one of said upper and lower camming surfaces being V-shaped with the mouth of said V being at least as wide as two-thirds the depth of respective carrier pans.

10. An internesting carrier pan assembly as claimed in claim 9 wherein said upper camming surfaces are respectively, spatially separated from, and located above, members which rotatably interconnect said suspension arms and said carrier pans whereby said upper camming surfaces contact lower camming surfaces to respectively rotate their carrier pans when they are free to assume desired attitudes.

11. An internesting carrier pan assembly as claimed in claim 10 wherein said upper camming surface is wedge shaped and said lower camming surface is V-shaped.

12. An internesting carrier pan assembly as claimed in claim 9 wherein said upper camming surface is wedge shaped and said lower camming surface is V-shped.

13. A mechanized file comprising:

a plurality of carriers each having a lateral shelf member and at least one side plate extending transversely of the shelf member for holding and storing articles;

a conveyor assembly for moving said carriers along an endless path, including at least one pair of vertically spaced wheels, a flexible member extending around and riding on said wheels, and suspension arms connected between the flexible member and carrier side plates for suspending the carriers from said flexible member so as to hold each carrier in contact with an adjacent carrier when moving along a linear path between said wheels and hold each carrier free of adjacent carriers when moving along a curved path around said wheels, said suspension arms being pivotably connected to the carrier side plates so as to permit a free carrier to rotate about a lateral axis through the pivot connection to assume a substantially level attitude in an unloaded condition;

a side plate of each carrier having a top camming surface and a bottom camming surface complementary to said top camming surface, the respective top and bottom camming surfaces being identical on the side plates of each carrier and constructed such that for the condition where an upper carrier is tiled about said lateral axis in one direction near an end of the curved path about the top wheel, the bottom camming surface of the upper carrier contacts the top camming surface of the adjacent lower carrier and is rotated back to a level attitude as said bottom camming surface of the upper carrier meshes with said top camming surface of the lower carrier; and a stationary nesting cam disposed proximate the end of the curved path about the top wheel for contacting the upper carrier, in a condition where it is tilted beyond a predetermined degree in the direction opposite to said one direction near the end of the curved path, to limit the tilt so that the bottom camming surface of the upper carrier contacts the top camming surface of the adjacent lower carrier and is rotated back to a level attitude as said bottom camming surface of the upper carrier meshes with said top camming surface of the lower carrier.

14. A mechanized file as claimed in claim 13 wherein at least one of said top and bottom camming surfaces of each of said carriers is V-shaped with the mouth thereof being relatively wide with respect to the depth of said carrier.

15. A mechanized file assembly as claimed in claim 14 wherein the mouth of said at least one camming surface is at least two-thirds of the depth of said carrier.

16. A mechanized file assembly as claimed in claim 15 wherein said top camming surface is wedge shaped and said bottom camming surface is V-shaped.

17. A mechanized file as claimed in claim 14 wherein each of said carriers includes a protruding guide member protruding from the side thereof and wherein said stationary nesting cam contacts said protruding guide members when carriers are at said predetermined tilts prior to their making contact with respective adjacent carriers.

18. A mechanized file assembly as claimed in claim 14 wherein said pivot connections between said suspension arms and carrier side plates are located relatively close to said top camming surfaces.

19. A mechanized file assembly as claimed in claim 13 wherein said top camming surface of each of said carriers is wedge shaped and said bottom camming surface is V-shaped.

20. A mechanized file as claimed in claim 13 wherein said pivot connections between said suspension arms and carrier side plates are located relatively close to said top camming surfaces.

* * * * *